US006254409B1

(12) United States Patent
Okabe et al.

(10) Patent No.: US 6,254,409 B1
(45) **Date of Patent: *Jul. 3, 2001**

(54) LEVER FITTING-TYPE CONNECTOR

(75) Inventors: Toshiaki Okabe; Tetsuya Yamashita, both of Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/360,630

(22) Filed: Jul. 26, 1999

(30) Foreign Application Priority Data

Aug. 10, 1998 (JP) ..... 10-226239

(51) Int. Cl.[7] ..... H01R 13/00
(52) U.S. Cl. ..... 439/157
(58) Field of Search ..... 439/157, 160, 439/152–156, 159

(56) References Cited

U.S. PATENT DOCUMENTS 3,801,757 * 4/1974 Carissimi et al. ..... 439/157
5,151,041 * 9/1992 Kaiser et al. ..... 439/157
5,711,682 * 1/1998 Maejima ..... 439/157

* cited by examiner

*Primary Examiner*—Renee Luebke
*Assistant Examiner*—Briggitte R. Hammond
(74) *Attorney, Agent, or Firm*—Sughrue, Mion, Zinn, Macpeak & Seas, PLLC

(57) ABSTRACT

A male connector 21 is fitted into a hood portion 35 of a female connector 23 by pivotally moving a lever 22 mounted on the male connector 21. Elastic provisionally-retaining arms 41 are formed on the lever 22, and at an initial stage of insertion of the male connector 21 into the hood portion 35, the provisionally-retaining arms 41 abut respectively against abutment projections 44 of the hood portion 35 to pivotally move the lever 22 into an initial connector-fitting position.

3 Claims, 3 Drawing Sheets

LEVER FITTING-TYPE CONNECTOR

BACKGROUND OF INVENTION

1. Field of Invention

This invention relates to a lever fitting-type connector in which a connector is fitted into a mating connector by pivotally moving a lever mounted on the connector.

2. Related Art

FIGS. 4 and 5 show a conventional lever fitting-type connector. This lever fitting-type connector comprises a male connector 1, a lever 2 pivotally mounted on the male connector 1, and a female connector 3 into which the male connector 1 is fitted.

The male connector 1 has a plurality of terminal receiving chambers 4 for respectively receiving terminals therein, which terminal receiving chambers 4 extend through the male connector 1 in an upward-downward direction. Rattle prevention ribs 6 are respectively formed on and project laterally from opposite side surfaces 5 of the male connector 1 at one end thereof, and extend in a connector-fitting direction. Bosses 7 are also formed on and project from the opposite side surfaces 5 of the male connector 1, respectively, and the lever is pivotally supported by these bosses 7.

The lever 2 includes a pair of right and left side walls 8, and an operating portion 9 interconnecting the right and left side walls 8 at their rear end portions. The right and left side walls 8 have holes, respectively, in which the bosses 7 are inserted so that the lever 2 can be pivotally moved about the bosses 7.

Projected portions 10 are integrally formed respectively on front ends of the two side walls 8 remote from the operating portion 9, and extend through the rattle prevention ribs 6 of the male connector 1. An engagement projection 11, serving as a supporting point at the time of pivotal movement of the lever, is formed on each side wall 8, and is disposed between the projected portion 10 and the boss 7.

The female connector 3 includes a hood portion 12 with an open top into which the male connector 1 is fitted. Elongate grooves 13 for respectively receiving the rattle prevention ribs 6 of the male connector 1 are formed in a front end portion of the hood portion 12. Engagement holes 14, in which the engagement projections 11 of the lever 2 are engaged, respectively, are formed through opposite side walls of the hood portion 12, respectively.

In this lever fitting-type connector, the bosses 7 of the male connector 1 are inserted respectively into the holes formed respectively in the opposite side walls 8 of the lever 2, and the projected portions 10 are passed respectively through the rattle prevention ribs 6 of the male connector 1, thereby assembling a lever assemble 15 shown in FIG. 5. Then, this lever assemble 15 is inserted into the hood portion 12, and the engagement projections 11 of the lever 2 are engaged respectively in the engagement holes 14 in the hood portion 12, and then the operating portion 9 is pressed to pivotally move the lever 2 in a counterclockwise direction (FIG. 5). Because of the leverage due to this pivotal movement, the whole of the lever assemble 15 is fitted into the hood portion 12, thus completing the assembling operation.

In the conventional lever fitting-type connector, however, the projected portions 10, formed at the front end of the lever 2, project respectively from the rattle prevention ribs 6 of the male connector 1, and therefore the lever assemble 15 interferes with the hood portion 12 because of these projecting portions. As a result of this interference, the lever 2 is pivotally moved in the counterclockwise direction, and is brought into an inclined condition as shown in FIG. 5, so that the lever 2 can not be pivotally moved.

Therefore, there is required a returning operation in which the lever 2 is once pivotally moved in a clockwise direction to be returned to its initial position. Therefore, for assembling the conventional lever fitting-type connector, there are required the step of assembling the lever assemble 15, the step of returning the lever 2 and the step of fitting the connector. Therefore, there are encountered problems that an increased number of assembling steps is needed, and that the assembling operation is cumbersome.

SUMMARY OF INVENTION

It is therefore an object of this invention to provide a lever fitting-type connector in which the need for the lever-returning operation is obviated, so that the number of assembling steps is reduced, and also the connector can be easily assembled.

The above object has been achieved by a lever fitting-type connector of the invention of claim 1 wherein a connector is fitted into a mating connector by pivotally moving a lever mounted on the connector; provided in that elastic provisionally-retaining arms are formed on the lever, and at an initial stage of insertion of the connector into the mating connector, the provisionally-retaining arms abut against the mating connector to pivotally move the lever into an initial connector-fitting position.

In this invention, at the initial stage of insertion of the connector into the mating connector, the provisionally-retaining arms, provided on the connector, abut against the mating connector, and as a result of this abutment, the lever is pivotally moved into the initial connector-fitting position, and therefore the lever is always brought into the initial position. Therefore, the operation for returning the lever to the initial position is not necessary, and the number of the assembling steps is reduced, and besides the assembling operation can be carried out easily.

In the invention of claim 2 according to claim 1, abutment projections, against which the provisionally-retaining arms can abut, respectively, are formed on the mating connector, and each of the provisionally-retaining arms has such elasticity that it can be elastically deformed in a direction to slide along the associated abutment projection. In this construction, the provisionally-retaining arms abut respectively against the abutment projections of the mating connector, so that the lever is pivotally moved into the initial connector-fitting position. In this invention, each of the provisionally-retaining arms has such elasticity that it can be elastically deformed in the direction to slide along the associated abutment projection. The provisionally-retaining arms abut respectively against the abutment projections to pivotally move the lever into the initial fitting position, and then when the connector is further inserted, the provisionally-retaining arms are elastically deformed, and slide respectively over the abutment projections, so that the whole of the lever can be inserted into the mating connector. Therefore, the provisionally-retaining arms will not hinder the insertion of the connector into the mating connector, and the connector can be smoothly inserted into the mating connector.

DETAILED DESCRIPTION OF PREFERRED EMBODIMENTS

Figure 1:
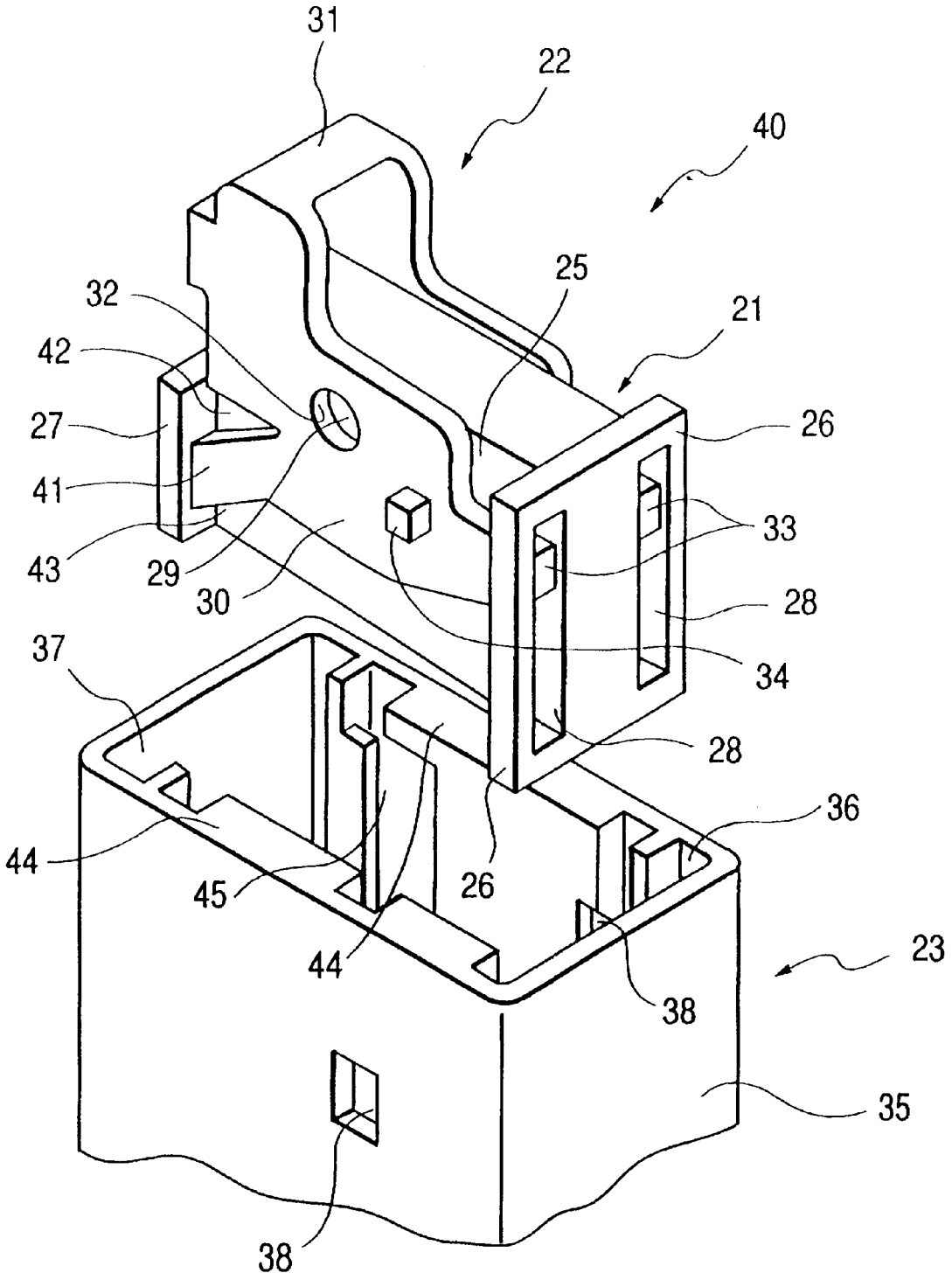
FIG. 1 is a perspective view of one preferred embodiment of a lever fitting-type connector of the present invention, showing a condition before it is assembled.
Figure 2:
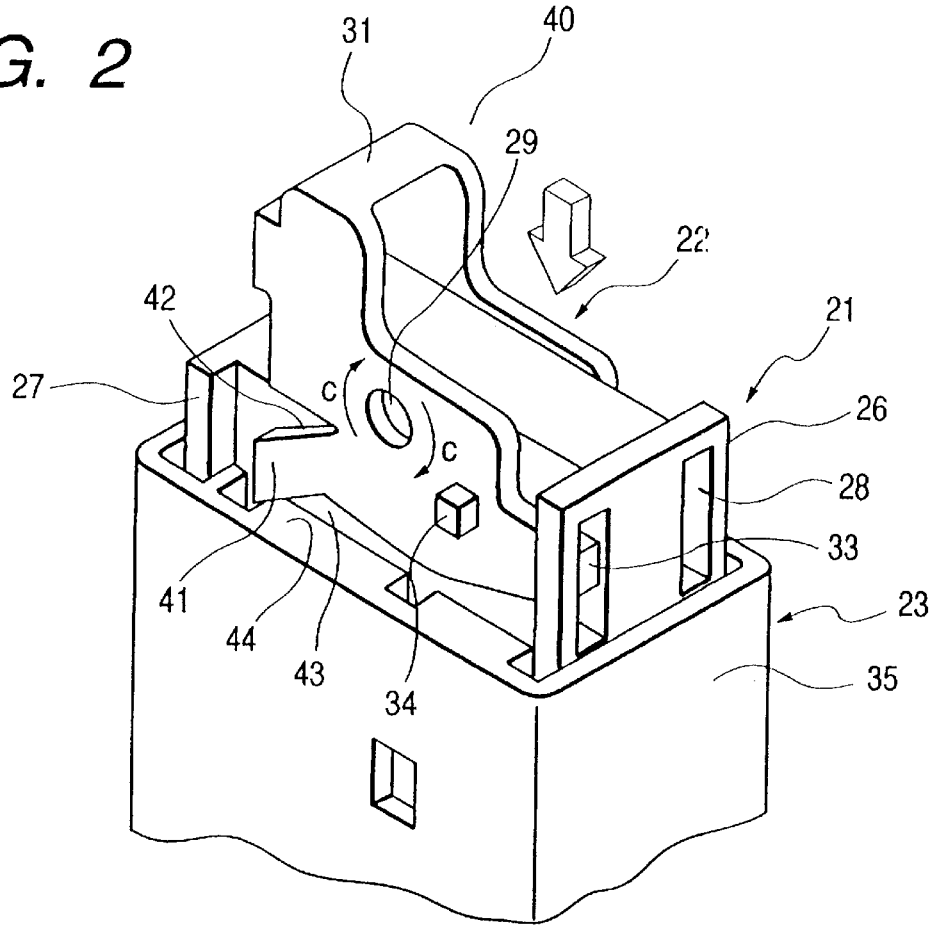
FIG. 2 is a perspective view showing an initial stage of insertion of a lever assemble into a hood portion.
Figure 3:
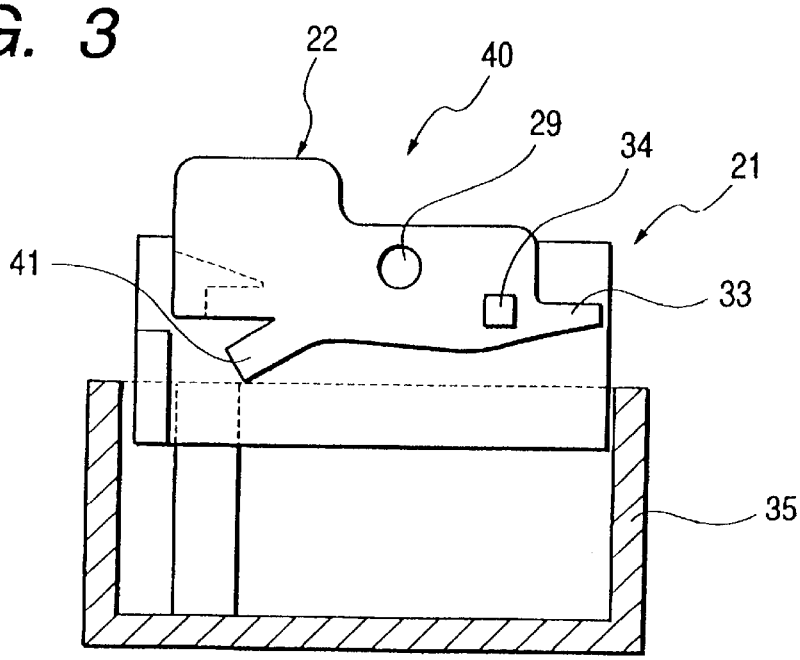
FIG. 3 is a side-elevational view showing the initial stage of insertion of the lever assemble into the hood portion.
Figure 4:
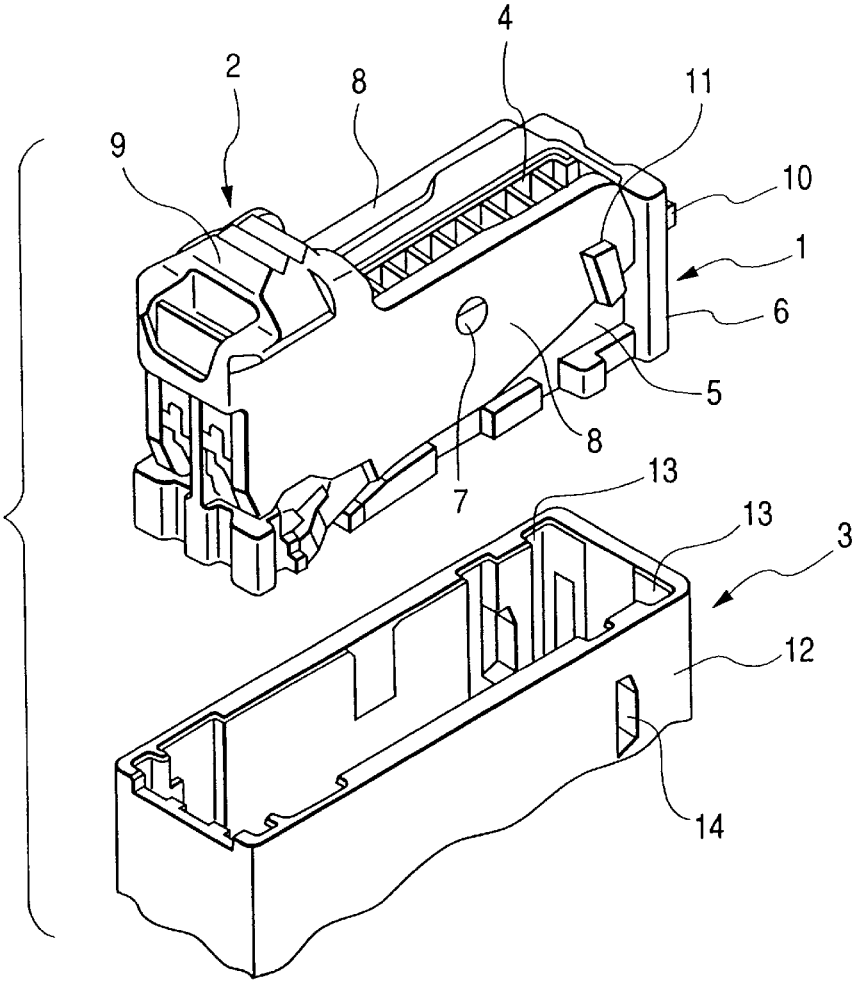
FIG. 4 is a perspective view of a conventional lever fitting-type connector.
Figure 5:
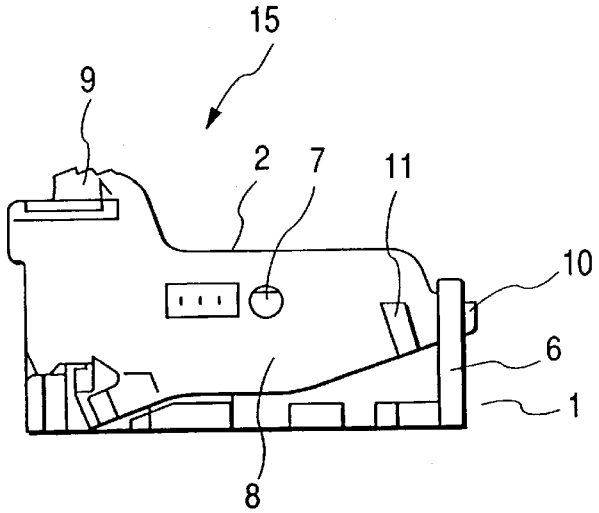
FIG. 5 is a side-elevational view of a lever assemble of the conventional lever fitting-type connector.

FIGS. 1 to 3 show one preferred embodiment of a lever fitting-type connector of the present invention. This lever fitting-type connector comprises a male connector (connector) 21, a lever 22 pivotally mounted on the male connector, and a female connector (mating connector) 23 into which the male connector 21 is fitted.

Like the conventional male connector, the male connector 21 has a plurality of terminal receiving chambers (not shown) for respectively receiving terminals therein. Rattle prevention ribs 26 are respectively formed on and project laterally from opposite side surfaces 25 of the male connector at one longitudinal end thereof, while rattle prevention ribs 27 are respectively formed on and project laterally from the opposite side surfaces 25 at the other longitudinal end thereof, these ribs 26 and 27 extending in a connector-fitting direction (upward-downward direction). Slots 28 are formed respectively in the rattle prevention ribs 26, formed at the front end of the male connector, and extend in the connector-fitting direction (upward-downward direction). Bosses 29 are formed on and project from generally-central portions of the opposite side surfaces 25 of the male connector 21, respectively, and the lever 22 is pivotally supported by the bosses 29.

The lever 22 includes a pair of right and left side walls 30, and an operating portion 31 interconnecting the right and left side walls 30. Rotation holes 32 are formed respectively through the pair of right and left side walls 30, and the bosses 29 of the male connector 21 is inserted respectively in the rotation holes 32.

When the two connectors are to be fitted together, the operating portion 31 of the lever 22 is operated or pressed, and when the lever is thus pressed, the lever 22 is pivotally moved in a counterclockwise direction, and at this time the operating portion 31 serves as a force-applying point while the bosses 29 serve as an application point. As a result of this pivotal movement, the connectors 21 and 23 are fitted together.

Projected portions 33 are integrally formed respectively on front ends of the right and left side walls 30 remote from the operating portion 31, and these projected portions 33 are inserted respectively in the slots 28 in the male connector 21, and therefore are engaged respectively with the rattle prevention ribs 26. The projected portions 33 are thus engaged respectively with the rattle prevention ribs 26, and therefore the lever 22 can be pivotally moved without rattling relative to the male connector 21, and also the lever 22 is prevented from being disengaged from the male connector 21, so that the condition of mounting of the lever 22 on the male connector 21 is stable.

The engagement projections 34 are formed on and project from the right and left side walls 30 of the lever 22, respectively. The engagement projections 34 serve as a supporting point at the time of pivotal movement of the lever 22. In this embodiment, each engagement projection 34 is disposed closer to the boss 29 than the projected portion 33 (formed at the front end of the side wall 30) is. Therefore, the distance between the supporting point (the engagement projection 34) and the application point (the boss 29) is reduced, and the operating force to be applied to the operating portion 31 can be reduced, and therefore the connectors 21 and 23 can be fitted together with a small force.

Provisionally-retaining arms 41 are formed on the opposite side walls 30 of the lever 22, respectively. Each provisionally-retaining arm 41 is disposed at the rear end portion of the side wall 30 remote from the projected portion 33, with the boss 29 lying therebetween. The provisionally-retaining arms 41 can be abutted respectively against abutment projections 44 formed on a hood portion 35 as described later, and as a result of this abutment, the lever 22 can be pivotally moved into an initial connector-fitting position.

Constrictions 42 and 43 are formed at the rear end portion of each side wall 30, and by doing so, the provisionally-retaining arm 41 is continuous with the side wall 30 through the constrictions 42 and 43, and is slanting slightly outwardly from the constrictions 42 and 43. With this construction of the provisionally-retaining arm 41, each provisionally-retaining arm 41 has such elasticity that it can be elastically deformed in a direction to slide along the associated abutment projection 44.

Like the conventional female connector, the female connector 23 has the hood portion 35 with an open top into which the male connector 21 is fitted. Elongate grooves 36 for respectively receiving the rattle prevention ribs 26 of the male connector 21, as well as elongate grooves 37 for respectively receiving the rattle prevention ribs 27, are formed in an inner surface of the hood portion 35, these elongate grooves 36 and 37 extending in the connector-fitting direction (upward-downward direction). Engagement holes 38 are formed through opposite side walls of the hood portion 35, and the engagement projections 34 of the lever 22 can be engaged in the engagement holes 38, respectively.

The abutment projections 44, corresponding respectively to the provisionally-retaining arms 41 of the lever 22, are formed on the hood portion 35. The abutment projections 44 are formed respectively on the opposite side walls of the hood portion 35 at the upper edge thereof, defining the upper opening, and are disposed so as to face the provisionally-retaining arms 41, respectively. When a lever assemble 40 is inserted into the hood portion 35 in order to fit this lever assemble 40 into the female connector 23, the provisionally-retaining arms 41 abut respectively against the abutment projections 44 at an initial stage of this inserting operation. At a result of this abutment, the lever 22 can be pivotally moved in the clockwise direction.

Grooves 45 are formed respectively in the opposite side walls of the hood portions 35, and extend downwardly respectively from the abutment projections 44, each groove 45 being recessed in a stepped manner relative to the associated abutment projection 44. The provisionally-retaining arms 41, after sliding along the respective abutment projections 44, are fitted into the grooves 45, respectively.

In the above embodiment, the bosses 29 are inserted into the rotation holes 32, respectively, and the projected portions 33 of the lever are inserted respectively into the slots 28, and therefore are engaged respectively with the rattle prevention ribs 26, thereby mounting the lever 22 on the male connector 21, and with this assembling operation, the lever assemble 40 is formed.

Then, this lever assemble 40 is inserted into the hood portion 35 from the upper side as shown in FIG. 3. This insertion is effected, with the rattle prevention ribs 26 and 27 (formed respectively at the opposite ends of the male connector 21), received respectively in the elongate grooves 36 and 37.

At an initial stage of the insertion of the lever assemble 40, the provisionally-retaining arms 41 of the lever 22 abut respectively against the abutment projections 44 of the hood portion 35, as shown in FIG. 2, and as a result of this abutment, the lever 22 is pivotally moved about the bosses 29 in the clockwise direction indicated by arrow C. As a result of this pivotal movement, the lever 22 is brought into the initial connector-fitting position where the engagement projections 34 are disposed close to the hood portion 35.

When the lever assemble 40 is further inserted, the provisionally-retained arms 41 are elastically deformed respectively toward the associated side surfaces 25 of the male connector 21, and as a result of this elastic deformation, the provisionally-retaining arms 41, so far abutted respectively against the abutment projections 44, slide along the abutment projections 44, respectively. Then, when each of the provisionally-retaining arms 41 passes past the associated abutment projection 44 to reach the associated groove 45, the provisionally-retaining arm 41 is brought out of sliding contact with the abutment projection 44. Therefore, the provisionally-retaining arms 41 are restored into their initial condition because of their elasticity.

Thereafter, by pressing the operating portion 31 to pivotally move the lever 22 in the counterclockwise direction, the whole of the lever assemble 40 can be fitted into the hood portion 35.

In this embodiment, at the initial stage of the insertion into the hood portion 35, the provisionally-retaining arms 41 abut respectively against the abutment projections 44 to pivotally move the lever 22 into the initial connector-fitting position, and therefore the lever 22 is always brought into the initial position. Therefore, the operation for returning the lever to the initial position is not necessary, and the number of the assembling steps is reduced, and besides the assembling operation can be carried out easily.

The provisionally-retaining arms 41 abut respectively against the abutment projections 44 to pivotally move the lever 22 into the initial fitting position, and then when the insertion is further effected, the provisionally-retaining arms 41 are elastically deformed, and slide. Therefore, the provisionally-retaining arms 41 will not hinder the insertion of the connector into the hood portion 35, and the connector can be smoothly inserted into the hood portion 35.

As described above, in first aspect of the present invention, the provisionally-retaining arms of the connector abut against the mating connector to pivotally move the lever into the initial connector-fitting position, and therefore the lever is always brought into the initial position. Therefore, the operation for returning the lever to the initial position is not necessary, and the number of the assembling steps is reduced, and besides the assembling operation can be carried out easily.

In the second aspect of the present invention, the provisionally-retaining arms abut respectively against the abutment projections, and then when the connector is further inserted, the provisionally-retaining arms are elastically deformed, and slide respectively over the abutment projections. Therefore, the provisionally-retaining arms will not hinder the insertion of the connector into the mating connector, and the connector can be smoothly inserted into the mating connector.

What is claimed is:

1. A lever fitting-type connector comprising:

a connector;

a lever mounted on said connector; and elastic provisionally-retaining aims formed on said lever, said provisionally-retaining arms abutting against a mating connector to pivotally move said lever in a first direction into an initial connector-fitting position at an initial stage of insertion of said connector into said mating connector, wherein said connector is drawn into said mating connector by pivotally moving said lever in a second direction opposite said first direction.

2. A lever fitting-type connector according to claim 1, wherein said mating connector includes abutment projections, against which said provisionally-retaining arms abuts, respectively, and each of said provisionally-retaining arms is elastically deformed in a third direction to slide along the associated abutment projection.

3. The lever fitting-type connector of claim 2, wherein said third direction is in a lateral direction, perpendicular to a direction of said insertion.

* * * * *